US005328090A

United States Patent [19]

Hanlon

[11] Patent Number: 5,328,090

[45] Date of Patent: Jul. 12, 1994

[54] STITCHLESS PAPERBOARD BREADTRAY

[76] Inventor: Allan T. Hanlon, 18 S. Maple Ave., Maple Shade, N.J. 08052

[21] Appl. No.: 124,263

[22] Filed: Sep. 21, 1993

[51] Int. Cl.[5] ..... B65D 5/22; B65D 5/30

[52] U.S. Cl. ..... 229/171; 229/172; 229/176; 229/178; 229/195; 493/162; 493/181

[58] Field of Search ..... 229/171, 172, 174, 176, 229/178, 195; 493/162, 177-179,181

[56] References Cited

U.S. PATENT DOCUMENTS

| | | | |
|---|---|---|---|
| 2,277,717 | 3/1942 | Sackett | 229/172 |
| 2,468,951 | 5/1949 | Barter | 229/176 |
| 3,077,294 | 2/1963 | Barrez | 229/195 |
| 3,887,126 | 6/1975 | Wilson | 229/176 |
| 3,910,484 | 10/1975 | Wozniacki | 229/171 |
| 4,180,200 | 12/1979 | Wilkinson, Sr. | 229/171 |
| 5,016,814 | 5/1991 | Fullerton | 229/195 |
| 5,022,582 | 6/1991 | Ritter | 229/157 |

FOREIGN PATENT DOCUMENTS

| | | | |
|---|---|---|---|
| 2460256 | 2/1981 | France | 229/178 |
| 2622537 | 5/1989 | France | 229/171 |
| 586813 | 12/1958 | Italy | 229/178 |

*Primary Examiner*—Gary E. Elkins

[57] ABSTRACT

A blank for forming a paperboard carton or breadtray having a bottom and four double ply walls with reinforced corners erected without stitches. Each corner has a double fold wrap around flap which is inserted through a slot in the adjoining wall and is captured between the plys. A reinforcing section folds down over the side section forming the two plys which are held together by a cutout which is inserted through a handle hole and locked by a tab inserted into the bottom section.

8 Claims, 5 Drawing Sheets

STITCHLESS PAPERBOARD BREADTRAY

BACKGROUND

1. Field of the Invention:

This invention relates to paperboard cartons erected from blanks of paperboard and particularly to a carton that has reinforced corners that do not require stitching.

2. Prior Art and Information Disclosure:

Corrugated paperboard cartons are available in many forms and designs depending on their intended use. These containers are manufactured as flat blanks and erected at the site of their intended use.

For example, U.S. Pat. No. 5,022,582 to Ritter is for a corrugated box with a flap locking feature for produce.

A carton designed for use in carrying loaves of bread has unique requirements. The loaves may not be stacked, must be accessible and preferably be displayed. Accordingly, a container style that has been in use for many years is the socalled bread tray. The bread tray has a width and length about equal to the average man's reach and has a depth about equal to the height of a loaf of bread.

There are available several versions of a breadtray according to the present state of the art. One such breadtray has a rectangular bottom with four sides folded vertically and then folded back to form four walls having a double thickness. Two of the opposing sides have flaps on their ends which fold against the adjacent walls and are stitched in place.

The standard breadtray with stitched corners has a number of inconveniences. One inconvenience is the requirement of a tool for stitching. The method of manufacture requiring stitching is expensive compared to the present invention. Another problem is that the stitches tend to pull out.

Containers have been constructed in which corners have been secured without stitches. This has been accomplished by a flap on a side wall end inserted through a slot in an adjacent wall, folded back such that a tab on the flap is then insertable in a slot. However, the strength of this corner construction has not been adequate for the purposes intended for the present invention and therefore this design approach has not been used in the construction of breadtrays.

THE INVENTION

Objects

It is an object of this invention to provide a carton that can be distributed as a flat blank and assembled at the site of its use without a requirement for a special stapling or stitching tool.

It is another object that the corners of the box be stronger than the stitched corner of the prior art.

It is another object of this invention to provide a breadtray for transporting and displaying loaves of bread.

It is yet another object that the carton of this invention may be dissembled to its original flat condition without destroying or disfiguring the breadtray.

Summary

This invention is directed toward a carton formed from a blank and having a corner with five fold thickness of corrugated paperboard secured by five locks. The blank includes a rectangular bottom section with four edges hingably joined to four side sections which are oriented perpendicularly to the bottom section to form the four walls. The side sections are folded in half such as to form double ply walls. The folded back sections of two opposing walls are folded away from one another and folded back portions of the other two walls are folded toward one another. The outwardly folded portions have ends with flaps which fold against the other respective adjacent sides of the box and an extension of each flap (referred herein as a "hook" flap) is inserted through a slot in the adjacent wall and folded back between the plys of the adjacent wall. A cutout for a hand hold folds inwardly down over the wall section and has a tab which is inserted into the bottom section thereby locking the double fold. The outer edges of the wall sections and flaps also have tabs which fit into slots in the bottom section and sides thereby locking the flaps and folded wall sections in place.

DESCRIPTION OF A PREFERRED EMBODIMENT

Figure 1A:
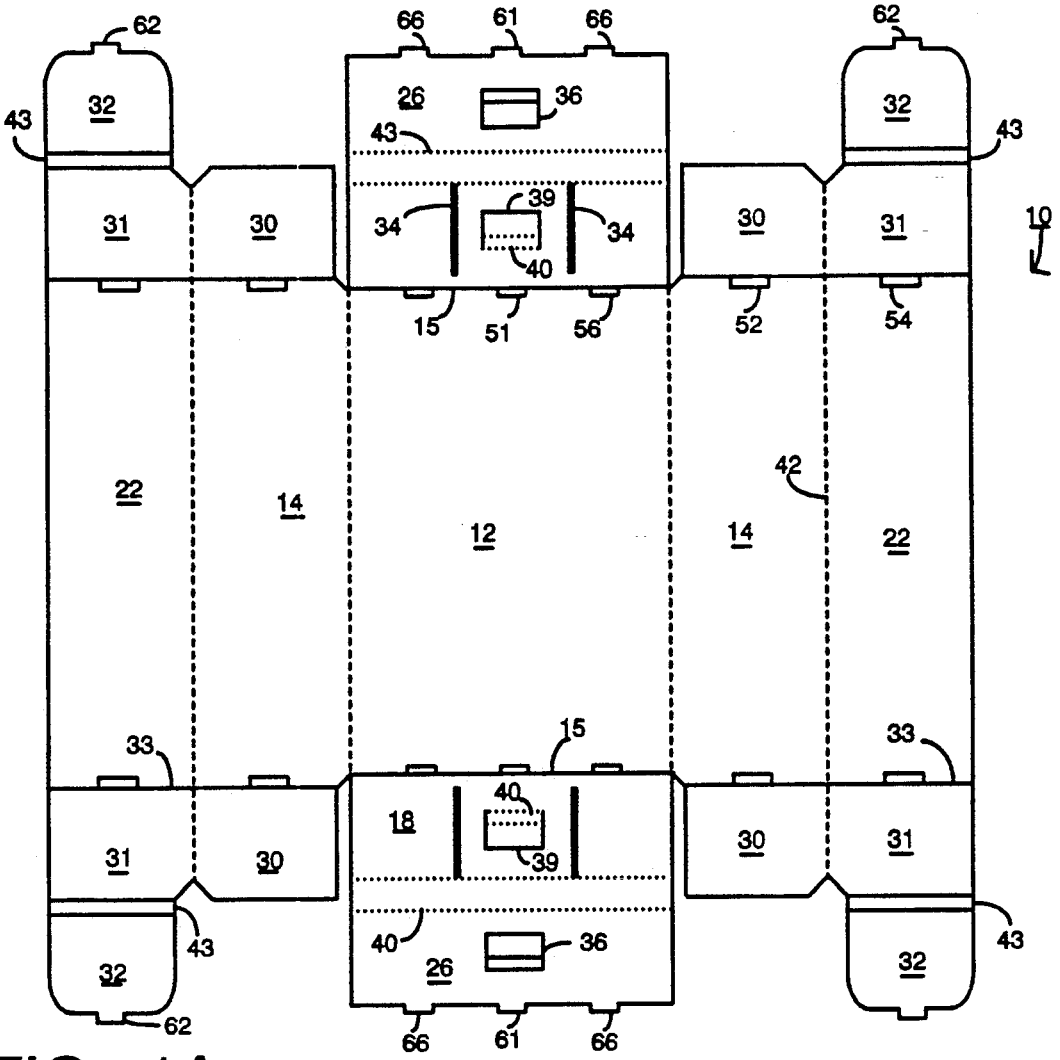
FIG. 1A shows the blank of this invention.
Figure 1B:
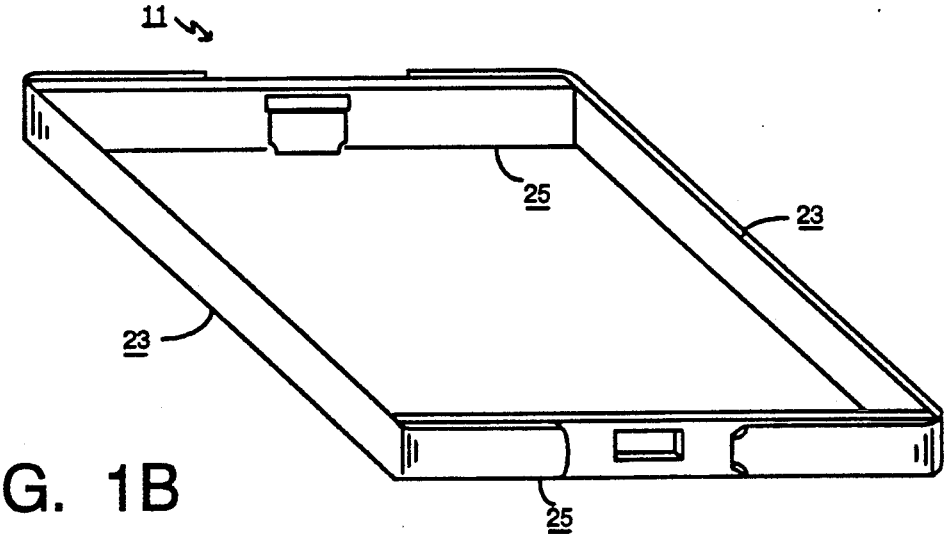
FIG. 1B shows the breadtray formed from the blank of FIG. 1A.

Turning now to a discussion of the drawings, FIG. 1A shows a blank 10 according to the invention. The carton 11 erected from the blank 10 of FIG. 1A is shown in FIG. 1B. The erected bread tray 11 is seen to be an approximately square shallow carton 11 having four side walls 23, 25 and a bottom section 12. All four walls, 23 and 25, are double ply.

Details of the blank 10 are shown to greater advantage in FIG. 2–9. FIGS. 2–9 show erection of a single corner which is representative of all four corners of the box so that the same item numbers refer to like parts in all four corners.

Figure 2:
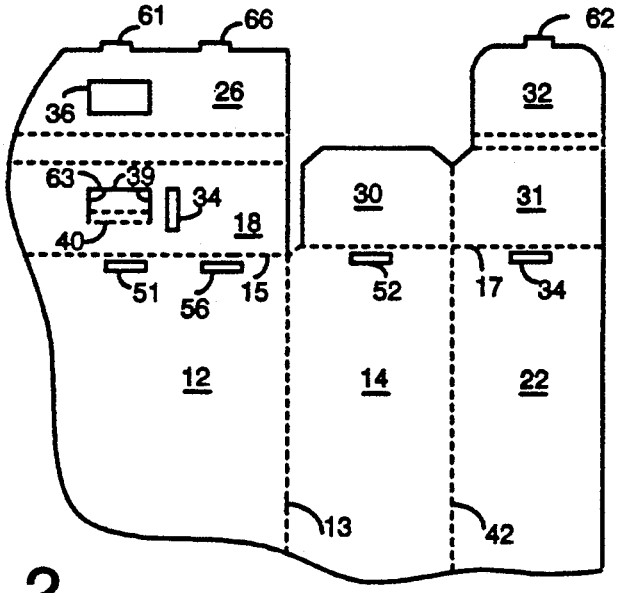
FIG. 2 shows a corner of the blank in closer detail.
Figure 3:
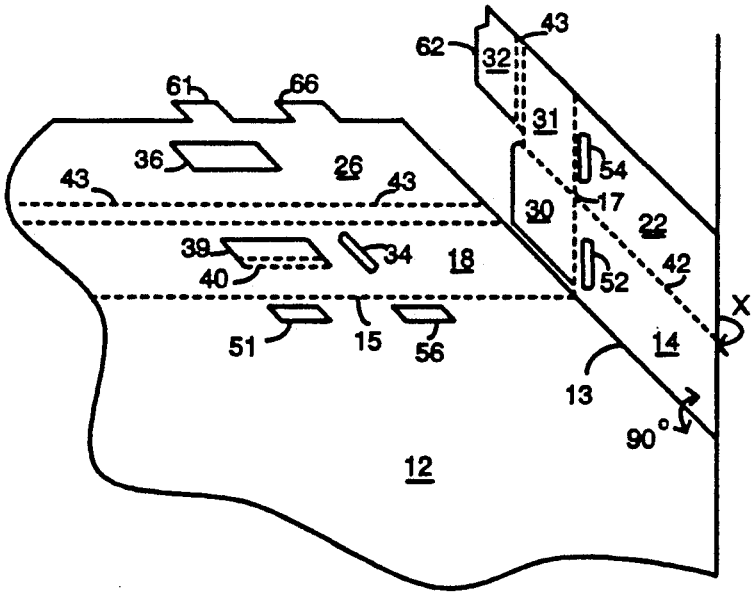
FIG. 3 shows orientation of the first side of the blank.
Figure 4:
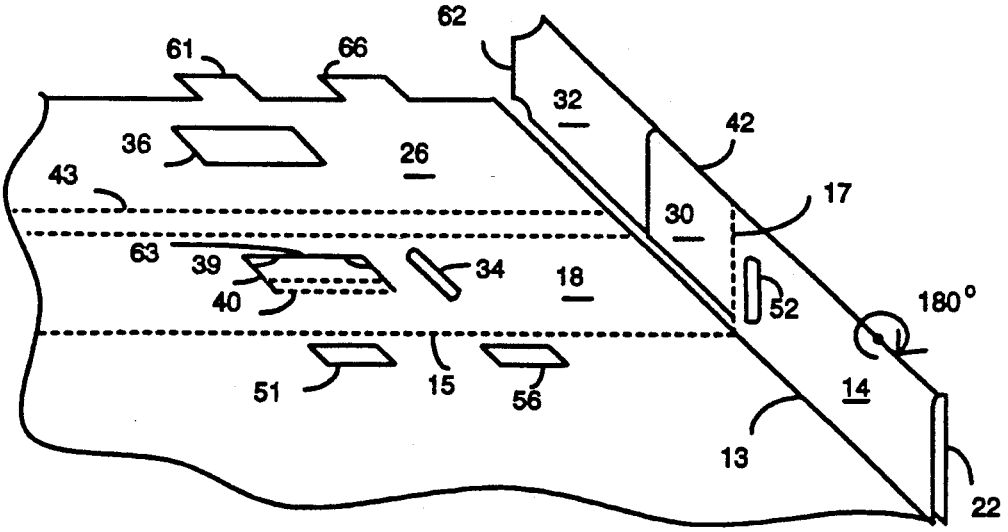
FIG. 4 shows folding back the reinforcing section of the first side.
Figure 5:
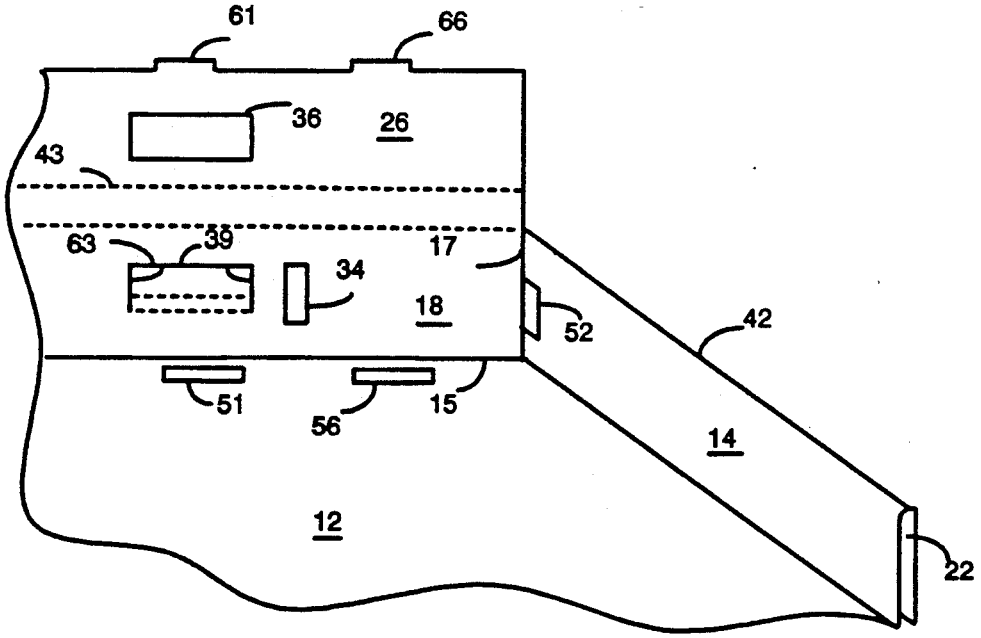
FIG. 5 shows orientation of the second section.
Figure 6:
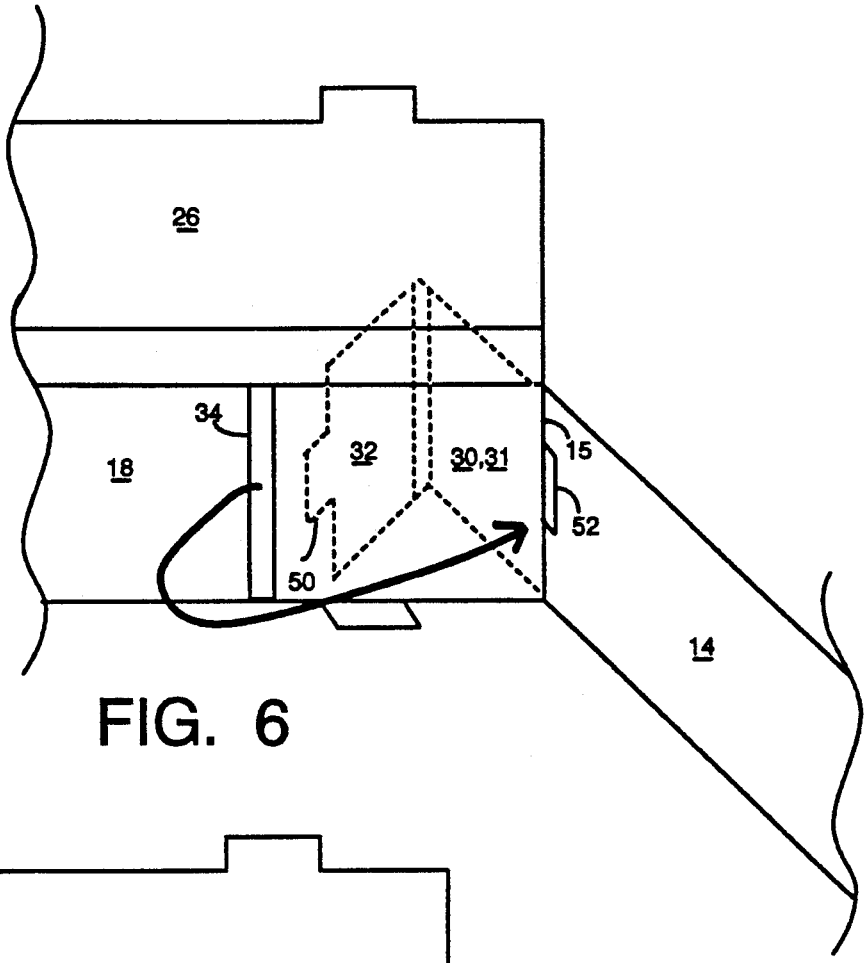
FIG. 6 shows insertion of the "hook" flap through the slot of the adjacent wall.
Figure 7:
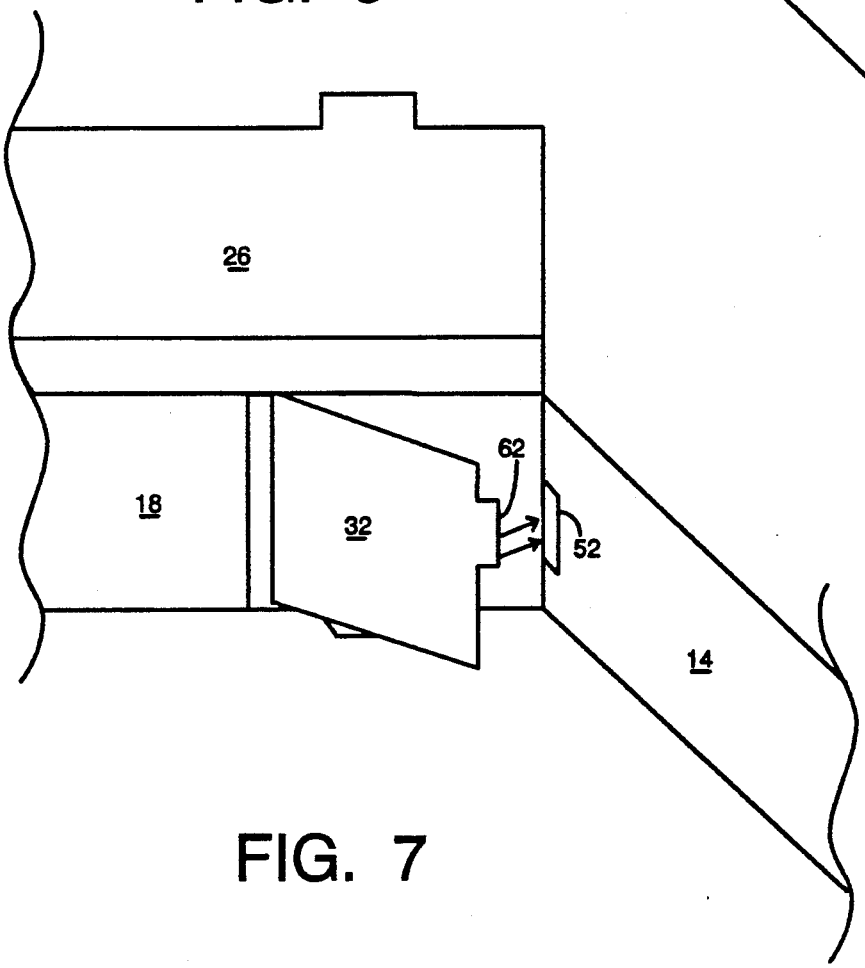
FIG. 7 shows folding the "hook" flap between the inner and outer plys.
Figure 8:
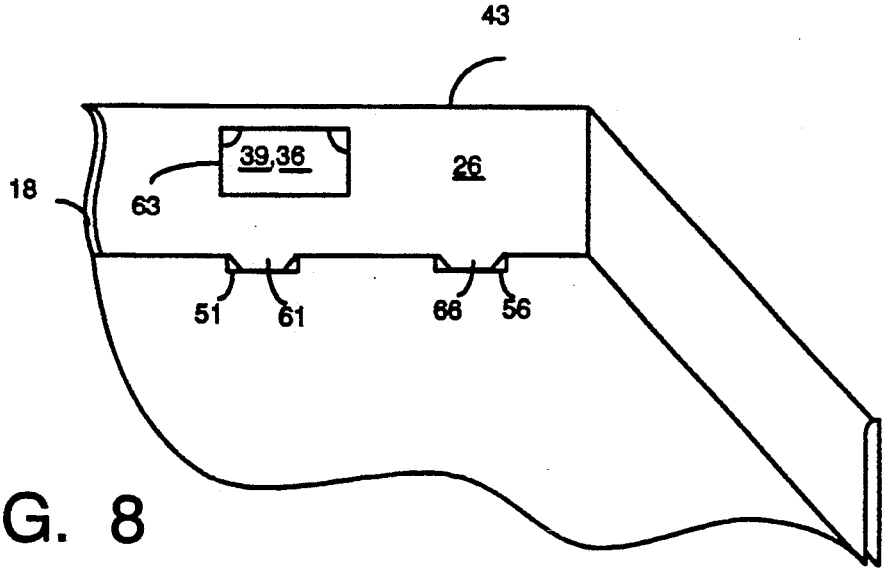
FIG. 8 shows folding the reinforcing section against the second section.
Figure 9:
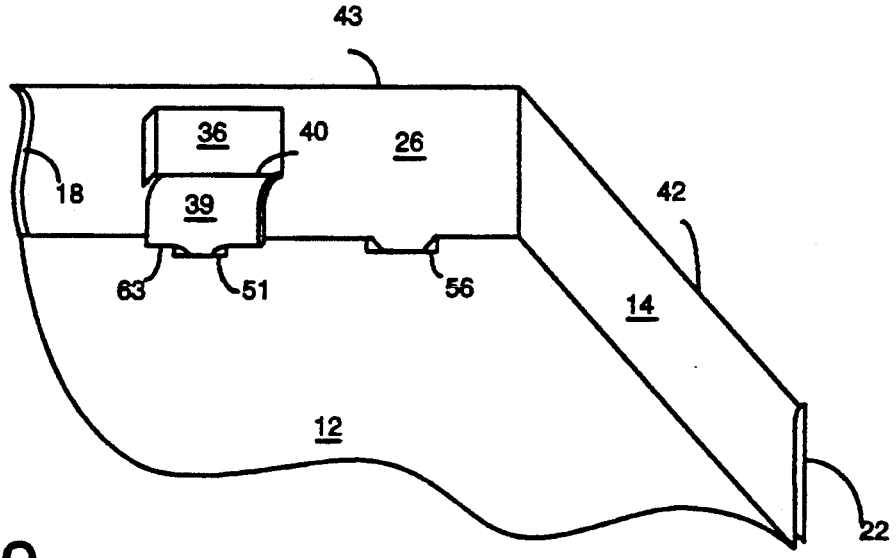
FIG. 9 shows folding the cutout through the hole in the side section and locking the reinforcing section in place.

FIG. 2 is a cutaway view showing rectangular bottom section 12 joined to side sections 14, and 18 along hinging lines 13 and 15. Side section 14 is joined to reinforcing section 22 along hinge line 42. Side section 18 is joined to reinforcing section 26 along double hinge line 43. Side section 14 has a flap 30 on each end and reinforcing section 22 has a flap 31 on each end which is an extension of flap 30. Flap 31 is attached to reinforcing section 22 along hinging line 17. A "hook" flap 32 is attached to flap 31 along double hinge line 43. Side section 18 has a short double hinge line 40 and a partial cutout 39. Reinforcing sections 22 each have a hole 36 for a handle. Slot 34 is shown in side section 18. Other slots 51, 52, 54 and 56 are shown for receiving tabs 61, 62, 63, 66 as discussed below.

In the context of this specification, the expression, "reinforcing section folded outwardly over the side section" is understood to mean that the reinforcing section forms the outer ply of the two ply sidewall formed by the reinforcing section and side section. Similarly, the expression, "reinforcing section folded inwardly over the side section" is understood to mean that the reinforcing section forms the inside ply of the two ply sidewall.

The expression "double hinging line" is understood to mean two straight parallel score lines in the paperboard that are spaced closely to one another such that a section on one side of the "double hinge" line can be folded back against the other section with just sufficient space between the two sections to permit positioning another ply between the sections. The term "cutout" will be understood to mean a cut in the paperboard wherein the cut does not form a continuous line so that no portion of the section in the region of the cut is separated from the section. Therefore, the cutout portion can be hingedly folded about a hinging line extending from one end of the cut to the other end of the cut such as when it is desired to form a hole for a hand hold.

Steps in erecting the box are shown in FIGS. 2-5 and are listed as follows: Only one corner is shown and discussed for purposes of greater clarity.

FIG. 3—Step 1:

Side section 14, is oriented about hinging line 13 to a vertical position with respect to bottom section 12.

FIG. 4—Step 2:

Reinforcing section 22 is folded back onto the outside of side section 14.

FIG. 5—Step 3:

Side section 18 is oriented along hinge line 15 to a position perpendicular to bottom section 12.

FIG. 6-Step 4:

Doubled flap 30-31 is folded along fold line 15 against side section 18 and flap 32 is folded along double hinge line 43 and inserted through slot 34. (See arrow.)

FIG. 7-Step 5:

Flap 32 is positioned between side section 18 and reinforcing section 26 and tab 62 on flap 32 is inserted into slot 52 and 54 in side section 14 and 22.

FIG. 8-Step 6:

Reinforcing section 26 is folded over side section 18 along double hinge line 43 and tab 66 is inserted into slot 56 in the bottom section 12. Tab 61 is inserted into slot 51.

FIG. 9-Step 7:

Cutout flap 39 is folded along double hinge line 40 through hole 36 and tab 63 is inserted into slot 51. (Tab 61 is also inserted into slot 51.)

A breadtray constructed in accordance with the steps outlined above provides greater strength and utility than other bread trays disclosed in the prior art. The novel construction is characterized by four double ply walls in which the corners are strengthened by flaps constructed with two additional plys of paperboard giving a four ply corner section. This feature has been accomplished by each wall having a side section and a reinforcing section with flaps extending from both sections, then imposing a double hinge line enabling the outside section of the flap to extend around an inner section. A further feature is a handle hole in two opposing walls formed by a hole in an inner ply and a matching cutout in the adjacent outer ply which is folded through the hole into the interior of the container and, by virtue of a double hinging line folds against the interior surface of the interior ply and secured in that position by inserting a tab on the cutout into a slot in the bottom of the container. Variations of the invention may be suggested by reading the specification and studying the drawings. I therefore wish to define the scope of my invention by the appended claims.

I claim:

1. A blank (10) for forming a carton (3) with four reinforced corners comprising:

said blank being substantially rectangular and having four corners;

a rectangular section (12) for forming a bottom and having a pair of opposing first bottom boundaries and a pair of opposing second bottom boundaries;

a pair of opposing first side sections (14) and a pair of opposing second side sections (18) operably arranged for forming sidewalls perpendicular to said bottom section (12), each one of said first side sections (14) having a first side boundary hingedly connected to one of said first bottom boundaries thereby defining one first hinging line of two first hinging lines (13) and each one of said second side sections having a second side boundary hingedly connected to one of said second bottom boundaries respectively to define one second hinging line of two second hinging lines (15);

a pair of first reinforcing sections, each one of said first reinforcing sections (22) having a third boundary hingedly connected to neighboring one of said first side sections (14) opposite said first side boundary thereby defining one of two third hinging lines (42) respectively;

a pair of second reinforcing sections, each one of said second reinforcing sections (26) having a fourth boundary double hingedly connected to a neighboring one of said second side sections (18) opposite said second side boundary thereby defining one of two fourth double hinging lines (43) respectively;

four side flaps, each one of said side flaps joined to an end boundary of a neighboring one of said first side sections (14) along a hinging line (15) that is an extension of one of said second hinging lines respectively (15);

four reinforcing flaps, each one of said reinforcing flaps joined to an end boundary of a neighboring one of said first reinforcing sections (14) along a hinging line (15) that is an extension of one of said second hinging lines respectively (15);

each one of said reinforcing flaps having an edge hingedly joined to one of said side flaps and each one of said side flaps having an edge hingedly joined to and edge of one of said reinforcing flaps;

four hook flaps (32), each one of said hook flaps located in one of said corners of said blank respectively, each said hook flap having a boundary double hingedly joined to a boundary of one of said reinforcing flaps forming a double hinging line that is an extension of one of said fourth double hinging line (43);

each said second side section (18) having two first slots (34), each said first slot (34) oriented perpendicular to a neighboring one of said second hinge lines; (15);

each one of said first slots (34) operably arranged to permit a neighboring one of said hook flaps (32) extending from a neighboring one of said first reinforcing sections (22) to be folded outwardly over a neighboring one of said first side sections (14) and be inserted through said each one of said first slots and be captured between said neighboring one of said second side sections and said neighboring one of said reinforcing sections, said neighboring one of said reinforcing sections being (26) folded inwardly over said neighboring one of said second side sections.

2. A blank as in claim 1 which comprises:

four first tabs, each one of said first tabs (62) on an outside edge of one of said hook flaps respectively;

four second slots, each one of said first side sections having two of said four second slots, each one of said second slots proximal to and parallel to a respective one of said end boundaries of said each one of said first side sections;

four third slots, each one of said first reinforcing sections having two of said four third slots, each one of said third slots proximal to and parallel to a respective one of said end boundaries of said each one of said first reinforcing sections;

each one of said first tabs on a neighboring one of said hook flaps operably arranged in combination with a neighboring one of said second slots and a neighboring one of said third slots (52), (54), to permit said each one of said first tabs to be inserted into said neighboring ones of said second and third slots, (52), and (54), when said neighboring one of said hook flaps (32) is positioned between a neighboring one of said second side sections and a neighboring one of said reinforcing sections.

3. A blank as in claim 1 which comprises:

a pair of first pluralities of second tabs; one of said first plurality of tabs being located on an outside edge of one said second reinforcing section and said other first plurality of second tabs being located on an outside edge of another one of said reinforcing sections;

a pair of first pluralities of fourth slots, each one of said fourth slots belonging to one of said first pluralities of fourth slots (56) being located in said bottom section (12), parallel to and proximal to one of said second hinging lines (15) distal from said other first plurality of fourth slots located proximal to said other second hinging line;

each one of said first pluralities of fourth slots (56) arranged in operable combination with a respective one of said first pluralities of second tabs and a neighboring one of said second reinforcing sections attached to a neighboring one of said second side sections to permit that with said neighboring one of said second reinforcing sections (26) folded inwardly and over said neighboring one of said second side sections (18) respectively, each one of said second tabs (66) is positioned to be inserted into one of said fourth slots (56) respectively.

4. A blank as in claim 1 which comprises:

each one of said second reinforcing sections (26) having a hole (36);

a pair of cutouts, each one of said second side sections (18) having one of said cutouts;

each one of said second side sections being joined to a respective one of said cutouts along a fifth double hinging line of a pair of fifth hinging lines such as to form a cutout tab in said each said second side section (26):

said bottom section (12) having two fifth slots (51), each one of said fifth slots being (51) parallel to and proximal to said one of said second hinging lines (51) opposite said other one of said second hinging line;

each one of said cutout tabs (63) operably arranged to permit folding a neighboring one of said second reinforcing sections (26) inwardly over a neighboring one of said second side sections (18), and folding said cutout tab (39) through a neighboring one of said holes (36) and against a neighboring one of said second reinforcing sections (26) with said each said third tab (63) inserted in a neighboring one of said fourth slots (51) such as to secure said neighboring one of said second reinforcing sections (26) against a neighboring one of said second side sections (18).

5. A blank as in claim 1 wherein each one of said side flaps (30) is hingedly connected to a neighboring one of said reinforcing flaps (31) along a hinge line (42) which is an extension of one of said third hinging lines. (42).

6. A paperboard carton (1) with four corner edges perpendicular to a bottom (12) which comprises:

a substantially rectangular bottom section (12) having two first bottom boundaries and two second bottom boundaries, said two first bottom boundaries being opposite one another and said second bottom boundaries being opposite one another;

a pair of first sidewalls facing each other, each one of said first sidewalls having a first side section with a bottom edge joining a neighboring one of said first bottom boundaries and a first reinforcing section against said first side section and inside said carton;

a pair of second sidewalls facing each other, each one of said second sidewalls having a second side section with a bottom edge joining one of said second bottom boundaries and a second reinforcing section against said second side section and inside said carton;

each said first side section having two end boundaries, each said end boundary being located in one of said corners of said box respectively;

each said first reinforcing section having two end boundaries, each said end boundary being located in one of said corners of said box respectively;

four first slots, each one of said second side sections having two of said first slots (34) perpendicular to said bottom section (12) and parallel to one another;

four reinforcing flaps (31), each one of said reinforcing flaps having an edge connected to one of said end boundaries of a neighboring one of said reinforcing sections, respectively;

four side section flaps (30), each one of said side section flaps having an edge connected to one of said end boundaries of a neighboring one of said side sections respectively;

each one of said reinforcing flaps and each one of said side section flaps being located in one of said corners of said carton respectively;

each one of said reinforcing flaps and a neighboring one of said side flaps folded together against a neighboring one of said second side sections outside said carton respectively;

four hook flaps (32), each one of said hook flaps extending from an end of a neighboring one of said reinforcing flaps (31) and inserted through a neighboring one of said first slots (34) and positioned between a neighboring one of said second side sections and a neighboring one of said second reinforcing sections.

7. A paperboard carton as in claim 6 which comprises:

two holes, each one of said second reinforcing sections having one of said holes (25);

two cutouts, each one of said second side sections joined to one of said cutouts along a double hinging line;

two cutout tabs, each one of said cutouts having one of said cutout tabs;

said bottom section having a pair of second slots (51) each one of said second slots being parallel to one of said second bottom boundaries opposite said other second slot located parallel to and proximal to said other second bottom boundary;

each one of said cutouts (39) inserted through a neighboring one of said holes (36) with one of said cutout tabs on said each one of said cutouts inserted through a neighboring one of said second slots (51).

8. A method for forming a carton with four reinforced corners from a blank which is substantially rectangular and having four corners and having a rectangular section (12) for forming a bottom and having a pair of opposing first bottom boundaries and a pair of opposing second bottom boundaries, a pair of opposing first side sections (14) and a pair of opposing second side sections (18) operably arranged for forming sidewalls perpendicular to said bottom section (12), each one of said first side sections (14) having a first side boundary hingedly connected to one of said first bottom boundaries thereby defining one first hinging line of two first hinging lines (13) and each one of said second side sections having a second side boundary hingedly connected to one of said second bottom boundaries respectively to define one second hinging line of two second hinging lines (15), a pair of first reinforcing sections, each one of said first reinforcing sections (22) having a third boundary hingedly connected to neighboring one of said first side sections (14) opposite said first side boundary thereby defining one of two third hinging lines (42) respectively, a pair of second reinforcing sections, each one of said second reinforcing sections (26) having a fourth boundary double hingedly connected to a neighboring one of said second side sections (18) opposite said second side boundary thereby defining one of two fourth double hinging lines (43) respectively, four side flaps, each one of said side flaps joined to an end boundary of a neighboring one of said first side sections (14) along a hinging line (15) that is an extension of one of said second hinging lines respectively (15), four reinforcing flaps, each one of said reinforcing flaps joined to an end boundary of a neighboring one of said first reinforcing sections (14) along a hinging line (15) that is an extension of one of said second hinging lines respectively (15) each one of said reinforcing flaps having an edge hingedly joined to one of said side flaps and each one of said side flaps having an edge hingedly joined to and edge of one of said reinforcing flaps, four hook flaps (32), each one of said hook flaps located in one of said corners of said blank respectively, each said hook flap having a boundary double hingedly joined to a boundary of one of said reinforcing flaps forming a double hinging line that is an extension of one of said fourth double hinging lines, (43) each said second side section (18) having two first slots (34), each said first slot (34) oriented perpendicular to a neighboring one of said second hinge lines; (15) each one of said first slots (34) operably arranged to permit a neighboring one of said hook flaps (32) extending from a neighboring one of said first reinforcing sections (22) to be folded outwardly over a neighboring one of said first side sections (14) and be inserted through said each one of said first slots and be captured between said neighboring one of said second side sections and said neighboring one of said second reinforcing sections, said neighboring one of said second reinforcing sections being (26) folded inwardly over said neighboring one of said second side sections, four first tabs, each one of said first tabs (62) on an outside edge of one of said hook flaps respectively, four second slots, each one of said first side sections having two of said four second slots, each one of said second slots proximal to and parallel to a respective one of said end boundaries of said each one of said first side sections, four third slots, each one of said first reinforcing sections having two of said four third slots, each one of said third slots proximal to and parallel to a respective one of said end boundaries of said each one of said first reinforcing sections, each one of said first tabs on a neighboring one of said hook flaps operably arranged in combination with a neighboring one of said second slots and a neighboring one of said third slots (52), (54), to permit said each one of said first tabs to be inserted into said neighboring ones of said second and third slots, (52), and (54), when said neighboring one of said hook flaps (32) is positioned between a neighboring one of said second side sections and a neighboring one of said reinforcing sections, each one of said second reinforcing sections (26) having a hole (36); a pair of cutouts, each one of said second side sections (18) having one of said cutouts, each one of said second side sections being joined to a respective one of said cutouts along a fifth double hinging line of a pair of fifth hinging lines such as to form a cutout tab in said each said second side section (26), said bottom section (12) having two fifth slots (51), each one of said fifth slots being (51) parallel to and proximal to said one of said second hinging lines (51) opposite said other one of said second hinging line, each one of said cutout tabs (63) operably arranged to permit folding a neighboring one of said second reinforcing sections (26) inwardly over a neighboring one of said second side sections (18), and folding said cutout tab (39) through a neighboring one of said holes (36) and against a neighboring one of said second reinforcing sections (26) with said each said third tab (63) inserted in a neighboring one of said fourth slots (51) such as to secure said neighboring one of said second reinforcing sections (26) against a neighboring one of said second side sections (18), a pair of first pluralities of second tabs; one of said first plurality of tabs being located on an outside edge of one said second reinforcing section and said other first plurality of second tabs being located on an outside edge of another one of said reinforcing sections, a pair of first pluralities of fourth slots, each one of said fourth slots belonging to one of said first pluralities of fourth slots (56) being located in said bottom section (12), parallel to and proximal to one of said second hinging lines (15) distal from said other first plurality of fourth slots located proximal to said other second hinging line, each one of said first pluralities of fourth slots (56) arranged in operable combination with a respective one of said first pluralities of second tabs and a neighboring one of said second reinforcing sections attached to a neighboring one of said second side sections to permit that with said neighboring one of said second reinforcing sections (26) folded inwardly and over said neighboring one of said second side sections (18) respectively, each one of said second tabs (66) is positioned to be inserted into one of said fourth slots (56) respectively:

said method including the steps:

(a) orienting each one of said first side sections (14), about a respective one of said first bottom boundaries hinging to a vertical position with respect to said bottom section (12);

(b) folding each one of said first reinforcing sections (22) onto the respective one of said side sections outside said carton;

(c) orienting each one of said second side sections (18) about a respective one of said second bottom boundaries to a position perpendicular to bottom section (12);

(d) folding each one of said second reinforcing sections (22) onto the respective one of said second side sections inside said carton;

(e) folding each one of said reinforcing flaps and neighboring side flaps along extended against a neighboring one of said second side sections (18) and inserting said hook flap attached to said each one of said reinforcing flaps through a neighboring one of said first slots (34) such that each one of said hook flap attached to said each one of said reinforcing flaps is captured between said each said one of said reinforcing flaps and said neighboring one of said side sections;

(f) inserting each one of said first tabs into a neighboring one of said second slots and a neighboring one of said third slots;

(g) folding each one of said reinforcing sections (26) over said side section (18) into said carton and inserting each one of said second tabs into a neighboring one of said fourth slots (56) in the bottom section (12);

(h) inserting each one of said cutout tabs through a neighboring one of said holes and inserting each one of said cutout tabs (63) into a neighboring one of said fifth slots (51).

* * * * *